US009011974B2

(12) United States Patent
Luangthep

(10) Patent No.: US 9,011,974 B2
(45) Date of Patent: Apr. 21, 2015

(54) PROCESS OF PRODUCING DECORATED METAL

(75) Inventor: Thanpuying Supornpen Luangthep, Bangkok (TH)

(73) Assignee: The Foundation for the Promotion of Supplementary Occupations and Related Techniques of Her Majesty Queen Sirikit, Bangkok (TH)

( * ) Notice: Subject to any disclaimer, the term of this patent is extended or adjusted under 35 U.S.C. 154(b) by 0 days.

(21) Appl. No.: 10/862,894

(22) Filed: Jun. 7, 2004

(65) Prior Publication Data

US 2005/0121414 A1 Jun. 9, 2005

(30) Foreign Application Priority Data

Dec. 9, 2003 (TH) ..... 087252

(51) Int. Cl.
*B05D 3/12* (2006.01)
*B44C 1/22* (2006.01)

(52) U.S. Cl.
CPC ..... *B44C 1/227* (2013.01); *Y10T 428/12993* (2015.01)

(58) Field of Classification Search
USPC ..... 428/457; 427/307, 309, 327, 328, 287, 427/290
See application file for complete search history.

(56) References Cited

U.S. PATENT DOCUMENTS

| | | | | | |
|---|---|---|---|---|---|
| 2,536,383 | A | * | 1/1951 | Mears et al. | 430/321 |
| 3,839,108 | A | * | 10/1974 | Leinkram | 216/48 |
| 3,847,689 | A | * | 11/1974 | Fletcher et al. | 216/75 |
| 4,400,252 | A | * | 8/1983 | Ushijima | 204/478 |
| 4,578,318 | A | * | 3/1986 | Schoch et al. | 428/615 |
| 4,675,206 | A | | 6/1987 | Ikegaya et al. | |
| 4,720,315 | A | | 1/1988 | Greenman | |
| 4,748,071 | A | | 5/1988 | Wild et al. | |
| 5,445,680 | A | | 8/1995 | Hamilton | |
| 5,761,799 | A | | 6/1998 | Mennucci | |

FOREIGN PATENT DOCUMENTS

| | | | | |
|---|---|---|---|---|
| JP | 56-9404 | Y2 | | 3/1981 |
| JP | 4-79840 | B2 | | 12/1992 |
| JP | 7-117395 | A | | 5/1995 |
| JP | 07-117395 | A | * | 9/1995 |
| JP | 2507812 | Y2 | | 5/1996 |
| JP | 2577523 | Y2 | | 5/1998 |
| JP | 11-20379 | A | | 1/1999 |
| JP | 2001-17305 | A | | 1/2001 |
| JP | 2002-475 | A | | 1/2002 |

OTHER PUBLICATIONS espacenet English abstract of JP 7-117395 A.
Official Action (Decision of Rejection) issued by the Japanese Patent office Apr. 19, 2011 in respect of corresponding Japanese Patent Application No. 2004-173359.
English Translation of the Decision of Appeal dated Jan. 4, 2013 for Japanese Application No. 2004-173359.
Office Action dated May 15, 012 for Japanese Application No. 2004-173359.
espacenet English abstract of JP 1263100 A.
espacenet English abstract of JP 11020379 A.
espacenet English abstract of JP 2001017305 A.
espacenet English abstract of JP 2002000475 A.

* cited by examiner

*Primary Examiner* — William Phillip Fletcher, III
(74) *Attorney, Agent, or Firm* — Ladas & Parry LLP

(57) ABSTRACT

A process of producing metal-decorating material, which causes no pollution to the environment and can be used both in industrial manner and handicrafts, for decorating article or process of decorating of various article surface, e.g., furniture, weapons, purse, box, small casket, etc. makes a pollen-like holder on at least one of the surface of a base metal plate and sets design creating material on said base metal surface by said pollen holder.

18 Claims, 2 Drawing Sheets

PROCESS OF PRODUCING DECORATED METAL

SUMMARY OF THE INVENTION

Figure 1:
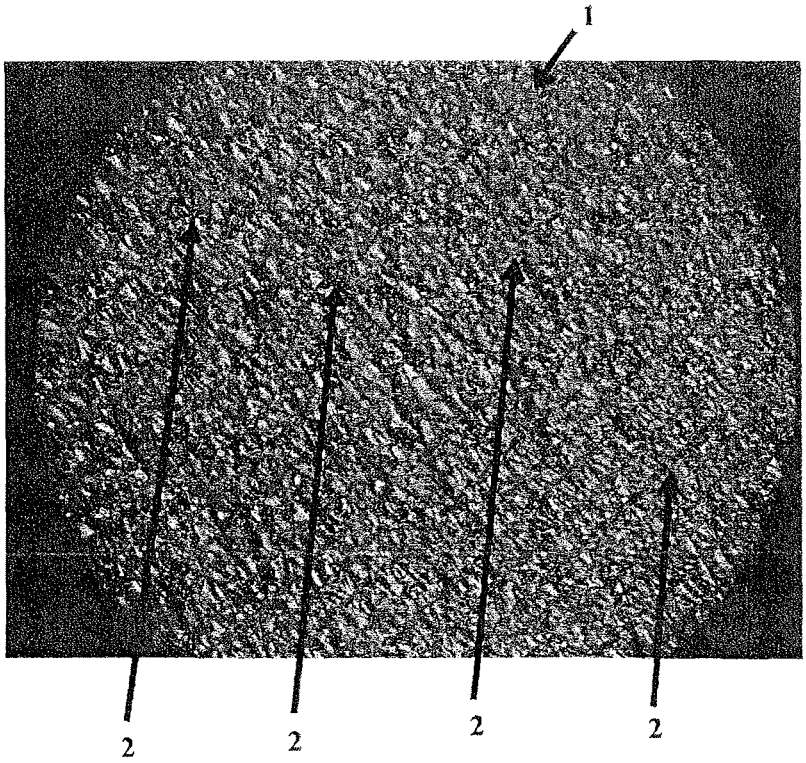
Figure 2:
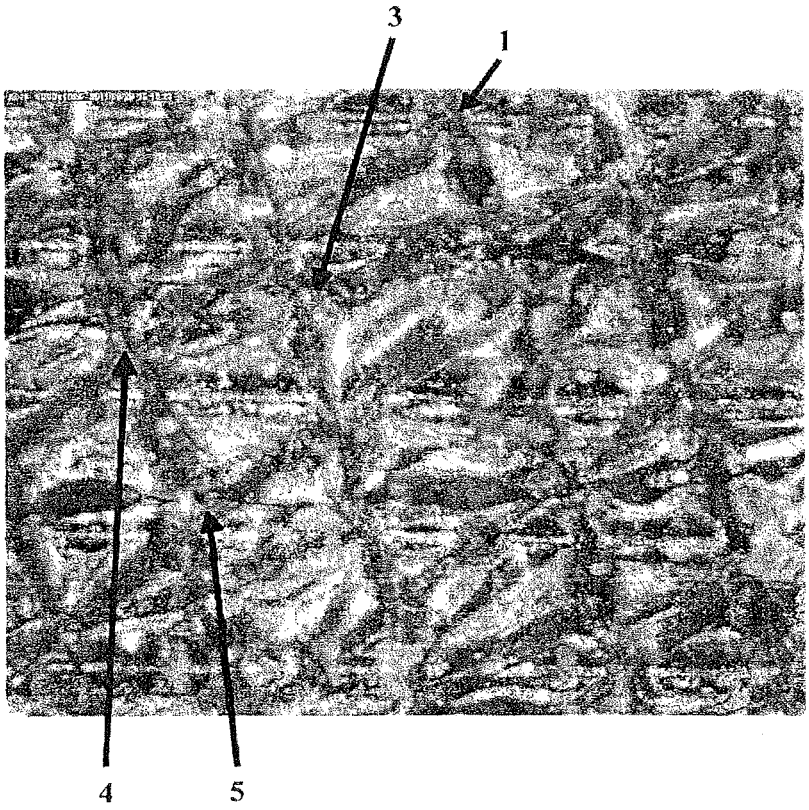

The invention purports to a process of producing metal-decorating material used as a piece of a decorating material on a surface of various articles, e.g., furniture, weapons, purse, etc. or an application of the process of the invention in order to produce various articles such that a metal surface of the article is decorated by design created by the process of the invention.

FIELD OF THE INVENTION

The present invention relates to a process of production of metal-decorating material of various designs, without the use of any chemical substance, which is the cause of pollution. The process of the invention is applied for creating a design on a metal surface of any article, or the process of the invention is applied for producing a metal decorating material in order to use for decorating on a surface of any article.

BACKGROUND OF THE INVENTION

In the production of any article, apart from the consideration of their utility, the aesthetics must be taken into account as well. There are different methods of decoration and beautification, e.g. carving, enameling or decorating with valuable materials, etc.

In case of metal article, different methods can be used to make decoration. However, in case that the decoration must involve the etching on the metal surface, the chemical substance is often used. Yet, there is a disadvantage that mostly the chemical substance will cause pollution.

DETAILED DESCRIPTION OF THE INVENTION

The invention purports to a process of producing metal-decoration material, which causes no pollution to the environment and can be used both in industrial manner and handicrafts such that the purpose thereof is to create an aesthetic appearance of the articles.

The term "metal-decorating material" used hereinafter both in this description and in the claims will include decorating material which is made of metal and can be used to decorate article made of metal or any other material; or the process of the present invention can be used directly to decorate the surface of metal article.

The term "article" used herein means material or an article used dn daily-life activities. The article includes, but is not limited to, furniture, component of a weapons such as sword handle and sword sheath, purse, etc.

The process of producing metal-decorating material of the invention consists of the step of making a pollenlike holder on the base metal surface which forms the base of the piece of the decorating material or the body of the article being made of metal, and the step of setting the design-creating material on said base material surface by using said pollenlike holder in setting the design-creating material on the surface of said base metal.

The term "base metal" used hereinafter means a metal piece or plate used as a base for producing a decorating material by applying the process of the present invention to a surface of the base metal such that a design is created thereon. The base metal may be any shape as desired such as triangular, rectangular, etc., and it may be a flat plate or a curved plate according to the article as desired.

The term "pollenlike holder" used hereinafter means a holder by which a design creating material can set onto the base metal surface, through the so-called "pollen" formed by the process of the present invention applied to a plane of the base metal surface as described later such that grooved markers crossing each other in a shape of a flower pollen can be formed on the surface of the metal plate. The process of production of metal-decorating material of various designs can be accomplished without the use of a chemical substance.

The design-creating material may be any kind of materials, which will embellish said base metal. As an embodiment of the invention, it is preferable to use precious metal, according to the periodic table, as design-creating material, e.g., gold, silver, platinum, etc. In this case, it is appropriate to roll or draw such precious metal to become a small thin thread about the size of a hair thread with the diameter of around 17 to 181 micrometers. In case that the decorating-material plate is produced before making decoration of the surface of the article, the base metal plate should not be more than 1 millimeters thick, even though the thickness and the width of the precious metal as well as the thickness of the base metal plate are not a critical point.

The process of producing the pollenlike holder could be done by etching said base metal surface, without using any chemical substance, but using any tool that could cause marks on the surface, e.g., a chisel, etc. Here, machines or human labour directly, may be used depending on the fineness of the desired work-piece. Thus, the pollen is formed by a crossing point of grooved markers etched in various directions on the base metal surface.

As an embodiment of invention, etching is defined as making the pollenlike marks on the surface of the base metal in order to be able to hold the design-creating material. This can be executed in the way that such marks cut across in different directions along at least 4 directions of the geographic directions on a plane of said base metal plate, namely:

1. the $1^{st}$ direction—from the north to the south, i.e. from the top of the base metal towards the bottom in the perpendicular line, or vice versa, 2. the $2^{nd}$ direction—from the west to the east, i.e. from the left of the base metal towards the right in parallel line with the horizontal level, or vice versa, 3. the $3^{rd}$ direction—from the north-east to the south-west, making an angle of 40-50 degrees to the line according to the $1^{st}$ order above, or vice versa, and 4. the $4^{th}$ direction From the northwest to the southeast, making an angle 40-50 degrees to the line according to the $1^{st}$ order above, or vice versa.

However, said etching is not necessary be in the order as mentioned above, that is, any etching direction may be optionally selected to perform first.

As an embodiment of the invention, the etching may be operated each time in one direction or more, depending on the tools used. Likewise, the next etching may be operated in the same direction, the reverse direction, the opposite direction or the slanted direction with respect to the previous one. The operation may be at least for 4 times (directions) or more, up to 8 times (directions).

Thus, in one set of the etching, if the etchings are performed along the 1st - 4th directions as defined above without etching in a reverse direction, then there are etchings for 4 times or 4 directions such that one pollen marker is formed at a intersection point as desired. If a different size is needed, then additional set of the etching is performed in the $5^{th}$, $6^{th}$, $7^{th}$ or 8th direction that may be the same direction, the reverse direction, the slanted direction or the parallel direction with respect to the previous direction depending upon the feature of the old one and the new one as desired.

There must be a lot of pollen markers on each of the base metal plate in such the way that the number of the etchings depend on the desired design created on said metal plate.

As an embodiment of the invention, the etching may be operated following the direction in order 1, 3, 4 and 2 as mentioned above respectively, or can be done reversely; or the etching operation may be opted to increase to 5 - 8 times or directions, following the order 3, 4, 1 and 2 or the reverse order.

In addition, by a characteristic of this invention, it is optional in each time or each direction of the etching operation, to apply different degrees of heavy or light force as desired, e.g. by the above-mentioned characteristic, the force put in the fifth etching may be lighter than that applied in the second one even though both are operated in the same direction. It's also optional to make a set operation, i.e., the force applied in the first round etching may be stronger than that used in the second round. Moreover, the etching may be operated in the same direction at the angle of equal degrees, or some different degrees. However, the different angles of about 1 - 5 degrees are appropriate; etching operation may be opted by using etching tool to make an angle of 70 - 120 degrees against the base metal surface; the more preferable is 80 - 100 degrees.

By a characteristic of the invention, the design creating material will be fixed on the surface of the base metal which is already etched into the pollenlike holder, in any design as desired, making the pollenlike holder be able to hold the design-creating material by using any process, e.g., use a setting tool. Additionally, the design-creating material may be fixed at the end of either times of the etching operation, as from the $4^{th}$ time to the $8^{th}$ time as desired.

As an embodiment of the invention, the opaque-area in the surface between decorating design may be punctured to become partly or entirely transparent space, by using any method, e.g., fretting or cutting off by any means or tool such as a chisel.

As an embodiment of the invention, the puncture may be done in the manner that the edge of such design stays in the right angle between both surfaces, in slanted angle, or in the way that the design follows one after another in orderly fashion.

As an embodiment of the invention, the process of this invention may be used to produce design decoration on both surfaces, either being the same design or not; or it can be done only on a single surface.

As an embodiment of the invention, metal-decoration material of this invention will consist of a piece of base metal that is etched to be pollenlike holder on the surface and the design-creating material held by such pollenlike holder. Accordingly, this pollenlike holder will function as a setter of the design-creating material, making it unmovable, without the use of any chemical substance. Thus, this will render economy and reduce pollution.

As an embodiment of the invention, metal-decoration material produced by using this process may be used to decorate article made of metal or any other materials, e.g., night pouch, photo frame, box, small casket, decorated gable end of royal or religious traditional Thai building, top roof of the junk, etc. Moreover, the process of this invention may be used to make the designs on the surface of any article as desired.

The invention claimed is:

1. A process of producing a decorated metal consisting of a base metal and a design decorating material, said process comprising the steps of:

a) making a holder on a surface of the base metal by etching along a plane of the surface of the base metal, wherein the etchings are performed in directions crossing each other for 4-8 times or in 4-8 directions; and b) setting the design decorating material on the surface of the base metal in the holder, wherein the design decorating material comprises threads having a diameter of approximately 17 to 181 micrometers, wherein said etching directions are selected from the group consisting of 4.1 direction 1 from north to south or vice versa, 4.2 direction 2 from west to east or vice versa, 4.3 direction 3 from northeast to southwest or vice versa, and 4.4 direction 4 from northwest to southeast or vice versa.

2. The process according to claim 1, wherein said directions may be slanted making any angle of different degrees as desired.

3. The process according to claim 1, wherein said directions as defined in 4.3 and 4.4 make any angle of 40 to 50 degrees to said direction in 4.1 or 4.2.

4. The process according to claim 3, wherein an etching operation proceeds 2 times or more in the same direction but making an angle of 1.5° to a direction of a previous etching.

5. The process according to claim 1, wherein etching directions 4.3 and 4.4 are selected to etch in a reverse or slanted direction which is the same as the previous direction.

6. The process according to claim 5, wherein a first set of etching may be selected in order 4.1, 4.3, 4.4, and 4.2, or vice versa.

7. The process according to claim 6, wherein an additional set of etching may be selected in order 4.3, 4.4, 4.1, and 4.2, or vice versa.

8. The process according to claim 1, wherein an angle between an etching tool used in said making step and the surface of the base metal is selected from 70 - 120°.

9. The process according to claim 8, wherein the angle between the etching tool and the surface of the base metal is selected from 80-100°.

10. The process accrediting to claim 9, wherein the design decorating material is set into the holder on the surface of the base metal at an end of the etching.

11. The process according to claim 1, wherein the design decorating material is Au.

12. The process according to claim 1, wherein the precious metals design decorating material consist of is gold, silver, and or platinum.

13. The process according to claim 12, wherein the precious metal may be rolled or drawn to be a small thread having a diameter of about 17 to 181 micrometers.

14. The process according to claim 1, further comprising puncturing the undecorated, opaque area of the surface between the decorating design to render it a design of partly or entirely transparent space by fretting or cutting off by any means or tool.

15. The process of claim 14, wherein the opaque area is fretted or cut off at an edge of the decorating design along a right angle or an angle of inclination or said opaque area is fretted such that the design is created on the opaque area in a way that said design can be extended from an existing design.

16. The process according to claim 1, wherein the decorative design on two base metal surfaces may be produced to become the same or a different decorative design.

17. A process of producing decorated metal, comprising:

using at least one instrument to etch at least four marks on a metal surface respectively in at least four directions cutting across each other, whereby to form a holder on the metal surface where the marks cut across each other; and setting a design material into the holder, wherein the design material comprises threads having a diameter of approximately 17 to 181 micrometers, wherein said etching directions are selected from the group of:

direction 1: from the north to the south, which is from the top of the metal towards the bottom in a perpendicular line, or vice versa, direction 2: from the west to the east, which is from the left of the metal towards the right in a parallel line with the horizontal level, or vice versa, direction 3: from the north-east to the south-west, making an angle of 40-50 degrees to the line according to the direction 1 above, or vice versa, and direction 4: from the northwest to the southeast, making an angle of 40-50 degrees to the line according to the direction 1 above, or vice versa.

18. The process according to claim 17, wherein:

the at least one instrument is used to form a plurality of holders;

the marks of at least one of the plurality of holders cut across each other at angles of 40 - 50 degrees;

a force of the using of the instrument to etch at least one of the marks of at least one of the plurality of holders is different from a force of the using of the instrument to etch at least one other of the marks of the same one of the plurality of holders;

the setting is by using a setting instrument; and the design material comprises at least one of gold, silver, and platinum.

* * * * *